United States Patent [19]

DeCoste

[11] 4,414,440

[45] Nov. 8, 1983

[54] WATERPROOF ELECTRICAL SWITCH WITH SAFETY INTERLOCK

[75] Inventor: Stephen H. DeCoste, Chatham, N.J.

[73] Assignee: Midland-Ross Corporation, Cleveland, Ohio

[21] Appl. No.: 280,542

[22] Filed: Jul. 6, 1981

[51] Int. Cl.[3] ..... H01H 9/20

[52] U.S. Cl. ..... 200/50 B

[58] Field of Search ..... 200/50 R, 50 B, 330, 200/51.09

[56] References Cited

U.S. PATENT DOCUMENTS

| | | | |
|---|---|---|---|
| 1,924,691 | 8/1933 | Lofgren | 200/50 B |
| 1,947,634 | 2/1934 | Anderson | 200/50 B |
| 1,971,990 | 8/1934 | Reynolds et al. | 200/50 B |
| 2,015,543 | 9/1935 | Bissell | 200/50 B |
| 2,420,865 | 5/1947 | Conlan | 200/50 B |
| 3,339,038 | 8/1967 | Jorgensen et al. | 200/50 B |

FOREIGN PATENT DOCUMENTS

| | | | |
|---|---|---|---|
| 750497 | 6/1956 | United Kingdom | 200/50 B |

*Primary Examiner*—J. R. Scott

*Attorney, Agent, or Firm*—H. Duane Switzer

[57] ABSTRACT

A water-tight housing (80) has a circuit breaker (71) mounted in its interior. A plug receiving structure (70) selectively receives an electrical plug (75). A locking pin (12) is slidably mounted through the housing to engage the electrical plug and undergo sliding movement upon receipt and withdrawal of the plug. The locking pin has a cam surface (42) for selectively camming a locking plate (10). An actuator rod (16) having a forward edge (21) is slidably received through the housing in operative connection with the circuit breaker for changing the circuit breaker between ON and OFF states. The actuator rod passes through an aperture (22) in the locking plate. The locking plate opening has a large region (23) for allowing free sliding movement of the actuating rod and a small region (24) for selectively engaging the forward edge in a locking relationship. A lost motion connection (54) includes an elongted slot (17) operatively connected with the locking pin for movement therewith and a pin (55) operatively connected with the actuator rod. The lost motion connection and the locking plate provide a dual safety interlock to block switching of the circuit breaker to its ON state in the absence of a received electrical plug.

6 Claims, 7 Drawing Figures

FIG 3
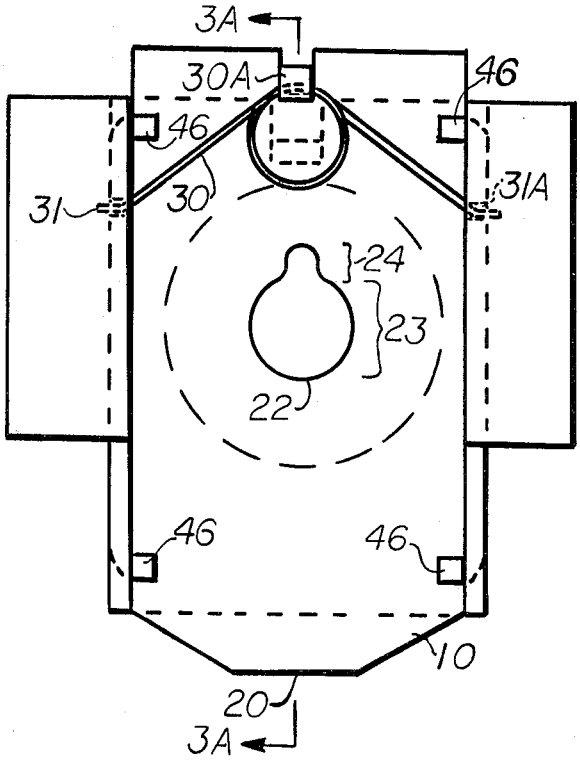
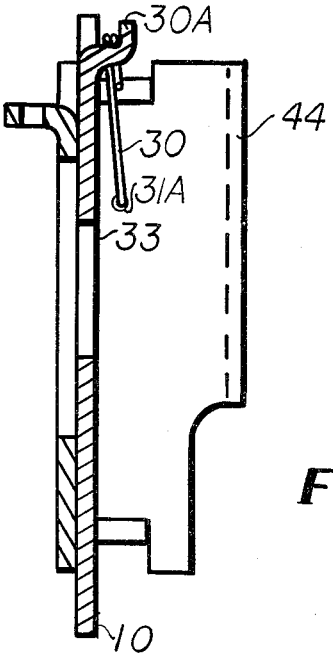
FIG 3A

WATERPROOF ELECTRICAL SWITCH WITH SAFETY INTERLOCK

BACKGROUND OF THE INVENTION

1. Summary of the Invention

This invention relates to a watertight receptacle in which the electrical contacts of the receptacle can not be energized when exposed to human touch and in which the electrical plug withdrawal deenergizes the electrical contacts.

2. Description of the Prior Art

Watertight electric outlet receptacle have been in use at shore side and ship board installations for many years. Essentially, one prime application involves refrigerated containers being transported on land with the refrigeration being powered by the transporter. Once at dock side or in place on board ship, the refrigeration unit receives its power from an electrical installation which quite obviously must be watertight due to the wet environment and the associated corrosive problem. Experience has shown that the electrical receptacles, which are typically 220 and 440 volt installations, must be not only protected from the environment but also must not have exposed electrical contacts which can be accidentally or inadvertently contacted by a human.

While there have been many approaches to the problem, there is still a need in the market place for a device which is extremely simple in construction, uses few parts and is low in cost.

In attempting to achieve a design which would overcome these problems one cannot simply look to the extensive electrical receptacle art relating to, by way of example explosion proof electrical receptacles, since the basic criteria for explosion proof receptacles and waterproof receptacles are basically incompatible. Explosion proof receptacles must provide means for gas, which seeps into the receptacle region in which sparking occurs, to be released from the receptacle in the event of an internal explosion due to the spark. This must be done at a rate which is slow enough for the gas to be cool before hitting the atmosphere and therefore avoiding ignition of ambient gas. A watertight receptacle would preclude gas from being released at a regulated rate since the container would have to be totally sealed, but would not entirely preclude entry of gas to the unit due to the far greater permeability of gas than water. In the event of a spark induced explosion, the restricted travel of the gas would either cause the container to blow apart or else, upon rupturing the seal, cause hot gases to be released with the danger of a major explosion occuring. By way of contrast, the controlled fluid egress-ingress provided in explosion proof receptacles would permit moisture and water to enter the receptacle causing corrosion and destroying the value of the device.

Of even greater consequence than the functional difference between the explosion proof and watertight seals, is the difference between the regions which must be sealed. In the waterproof units corrosion must be prevented with respect to all components whereas in explosion proof units, the restricted flow seal must be limited to a confined region around the spark producing switch. Thus, not only is the mode of sealing different, but all of the critical regions to be sealed are different.

For these reasons, attempts to adapt explosion proof receptacles to waterproof applications have met with little success. Typically a specific design for watertight units is required so that all elements can be totally sealed which goes beyond the mere replacement of waterproof seals for restricted flow gaskets.

Looking to the explosion proof receptacle type of prior art one finds that devices have been known for an extensive period of time which can provide some of the currently desired functions. For example, U.S. Pat. No. 1,947,634 issued in 1934 broadly disclosed the idea of locking a plug to a receptacle and controlling the activation of power through a plunger type lever. In 1935 U.S. Pat. No. 2,015,543 disclosed a safety locking mechanism in which a plug cannot be either inserted or removed from a receptacle unless the power control switch was in the off position. Switch boxes or receptacles which have a plug receiving means and an interlock for enabling an electrical switch to be moved to an ON state only when a plug is received in the plug receiving means are known in the prior art. Such arrangements enable power to be supplied only when a plug is properly inserted in a plug receiving means or receptacle. These prior devices as, for example, evidenced in U.S. Pat. No. 1,934,024 issued 1933, 1,971,990 issued in 1934, 1,731,893 issued in 1929, have not proven to be interchangeable or inter-adaptable and a device of the desired simplicity and safety characteristics has not been developed, not withstanding the extensive period in which there has been a need for a reliable, safe, watertight unit which cannot be activated unless a plug is properly in place. U.S. Pat. Nos. 2,420,865 (1949) and 1,947,634 (1934) are illustrative of the time period under discussion.

BRIEF DESCRIPTION OF THE DRAWINGS

The objects and advantages of the invention will become apparent to those skilled in the art, from the following detailed description of a preferred embodiment of the invention when read in conjunction with the accompanying drawings, wherein:

FIG. 3 is a front view of the spring biased slide lock member and support;

FIG. 3A is a side view, partly in cross-section, of the slide lock mechanism and support mechanism taken along lines 3A—3A of FIG. 3;

DETAILED DESCRIPTION OF THE INVENTION

It has now been found that a device having a totally waterproof enclosure and employing few movable parts, that is, an extremely simple an inexpensive mechanism, is provided by the design of the instant invention.

Figure 1:
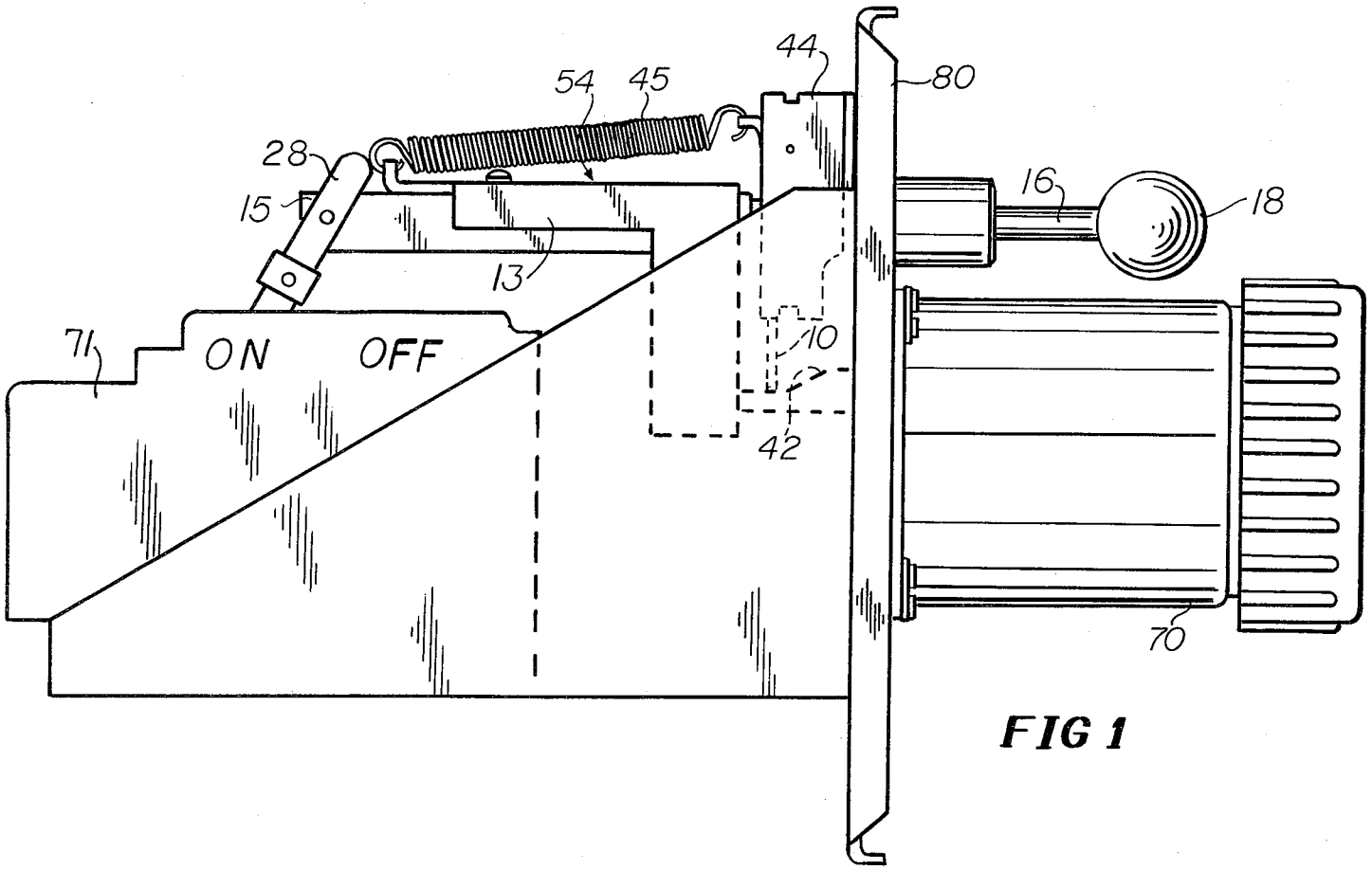
FIG. 1 is a side view of a preferred embodiment of a receptacle assembly, showing the plug out of the receptacle and the circuit breaker in the OFF condition.

With reference now to FIG. 1 a water tight housing 80 has a first passage means 82 (FIG. 2) extending therethrough for slidably receiving an associated structure, and a second passage means 84 defining an elongated passage therethrough in fluid communication with the interior of the housing for slidably receiving an associated structure. A locking slide member or a locking plate 10 cooperates with a shaft 16 which extends through the first passage means 82 to permit a circuit breaker 71 to be activated, that is, turned on, only when a plug 75 (FIG. 6) is positioned in a receptacle 70. Removal of the plug 75 automatically turns off the circuit breaker 71.

Figure 2:
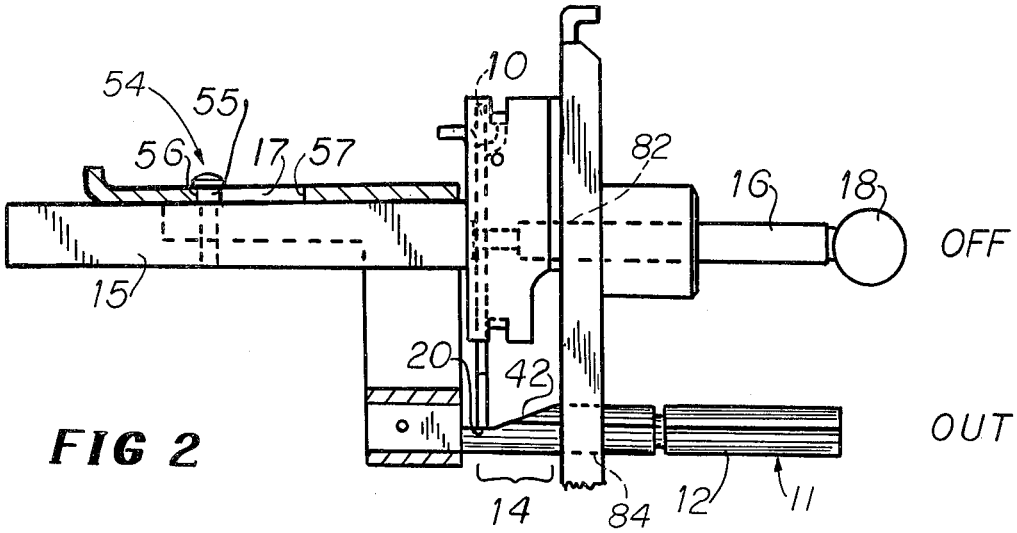
FIG. 2 is a fragmentary side view of a portion of the actuation and locking mechanism of the receptacle assembly of FIG. 1.

As illustrated in FIG. 2, a locking mechanism 11 includes a locking pin 12 through the second passage means 84, that has a cam region 14 which includes an inclined surface 42 which engages a bottom 20 of the locking slide member 10.

Figure 6:
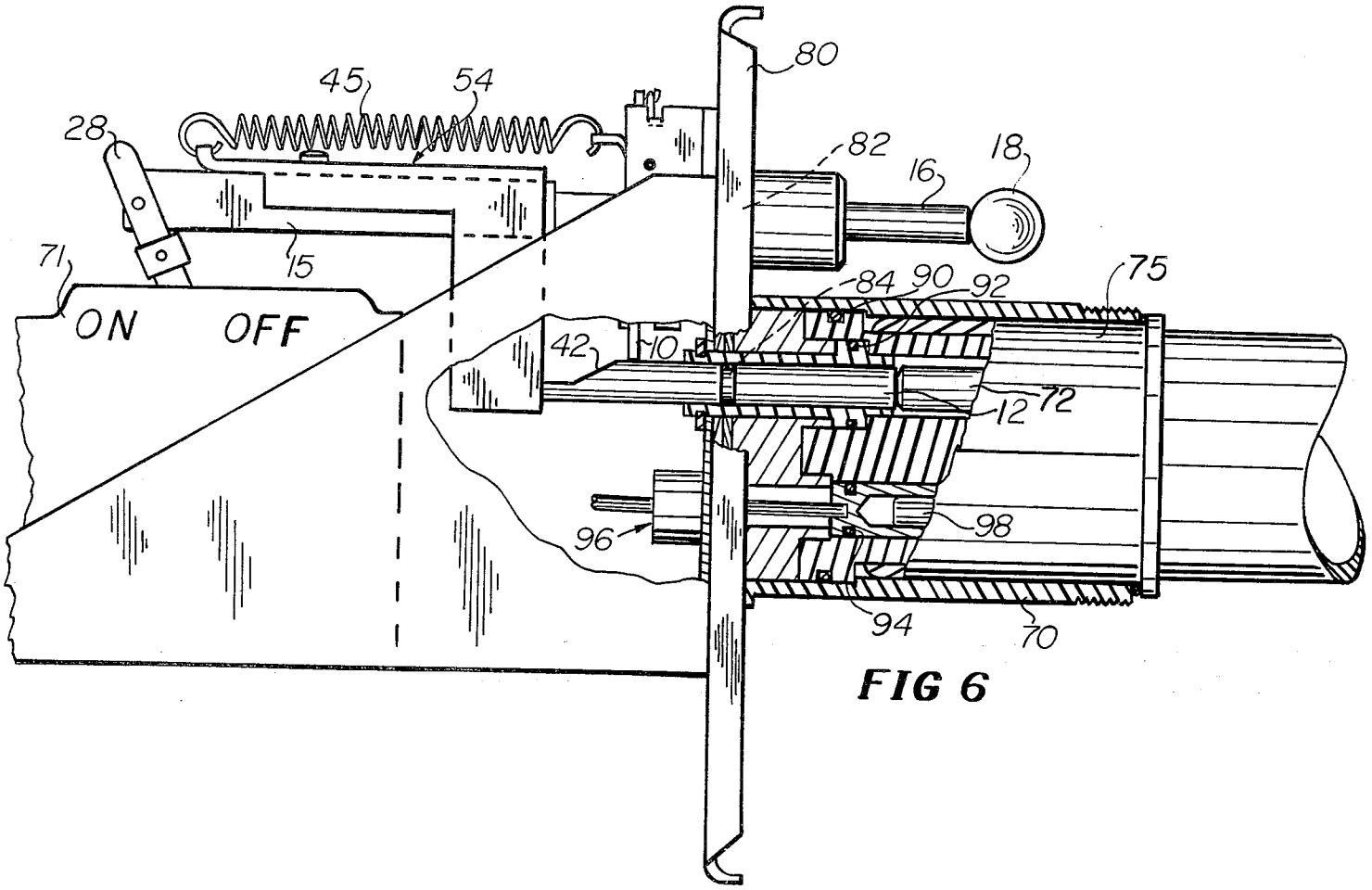
FIG. 6 is a fragmentary, side view, partly in section, of a plug of the type generally used in combination with the receptacle of the present invention.

A circuit breaker actuator means is provided for selectively, manually causing the circuit breaker 71 to be changed between ON and OFF states. The circuit breaker actuator means includes a rod actuator 16 which passes through an opening 22 (FIG. 4) in the locking slide member 10. With reference to FIG. 3, the opening 22 includes a first region 23 having a large enough clearance to permit the body of the actuator rod shaft 16 to freely pass through and a region 24 of small size which is of smaller clearance than required for passage of the shaft 16. The actuator rod 16 has a narrowed region 26 (FIG. 4) which is small enough to clear the small sized opening 24. Thus, with the actuator rod in its rearward position, as illustrated in FIG. 2, the shaft of the actuator 16 cannot be moved forward sufficiently to move the circuit breaker lever 28 to the ON position, as illustrated in FIG. 6.

Movement of the locking mechanism 11 in the direction indicated by the arrow 40 causes the lock slide 10 to be lifted by the inclined surface 42 of the cam region 14 of the locking mechanism 11. The upward movement of the lock slide 10 is resisted by any convenient spring biasing mechanism 30. Similarly, the return of the lock slide 10 to its lower most movement of the actuator rod in the opposite direction is downwardly urged by the spring mechanism 30.

It is preferable for the locking mechanism 11 to respond directly to the insertion and withdrawal of the plug. Therefore, the actuator rod assembly is spring biased rearwardly toward the plug 75 by a spring 45. Accordingly, upon withdrawal of the plug 75, the actuator rod 16 is caused to return to its rearward position, as illustrated in FIGS. 1 and 2.

Figure 5:
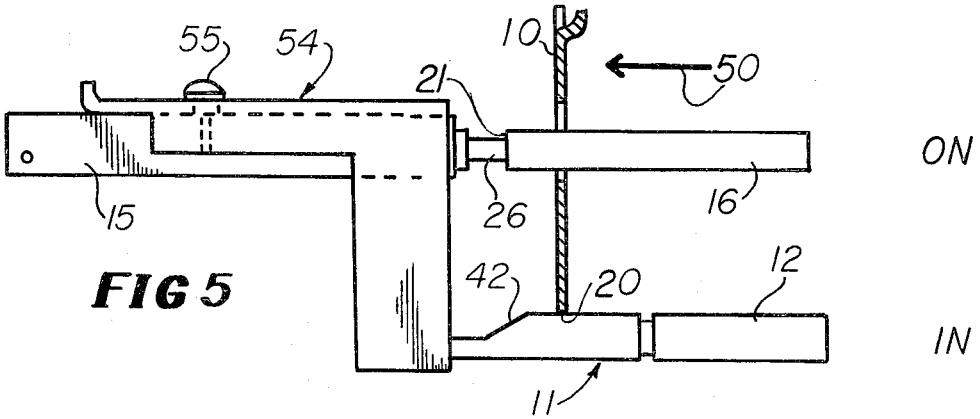
FIG. 5 is a partial side view, partly in section, of the embodiment of FIG. 4 showing the relative positions of the actuator mechanism and the locking cam when the plug is in the receptacle and the circuit breaker in the ON position.

Looking now to the position of the parts illustrated in FIG. 5, it is evident that with a plug 75 in place, the rod actuator 16 is free to move between the ON and OFF positions.

Figure 4:
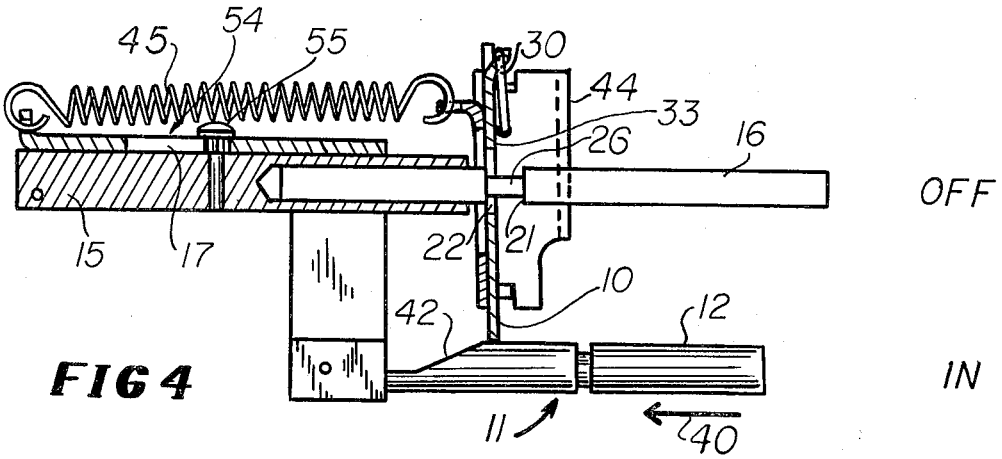
FIG. 4 is a side view, partly in section, of a portion of the embodiment of FIGS. 1 with the actuator mechanism in the OFF position and the locking cam in the IN position.

Following the sequence illustrated in FIGS. 2, 4 and 5, it is shown that the insertion of a plug 75 causes the locking pin 12 to be forced to the forward position as indicated by the arrow 40. In the position illustrated in FIG. 2, the forward edge 21 of the actuator rod 16 cannot move past the rearward edge 33 of the lock groove portion 24 of the locking slide opening 22 when the locking slide 10 is in its lowermost position. In this position, as illustrated in FIG. 2, the narrow region 26 of the actuator mechanism assembly is enclosed by the lock groove region 24.

When a plug 75 is inserted into the receptacle 70, a pin 72 of the plug 75 forces the locking pin 12 forward, raising the locking slide 10. The upward movement of the locking slide 10 is resisted by the spring 30 which is carried on the locking slide 10 by means of a spring support 30A. The locking slide member 10 is held against side to side and forward or backward motion by means of a locking slide support 44. Four inwardly turned tabs 46 serve as guides for the locking slide member 10.

With the locking slide member 10 in its upper position, the actuator rod 16 is free to move within the large region 23 of the locking slide opening 22 in the direction indicated by the arrow 50. The circuit breaker actuator means includes a lever connecting member 15 which is linked to a lever 28 of the circuit breaker 71 and causes the circuit breaker to be switched ON, as illustrated in FIG. 6.

With reference again to FIG. 2, locking assembly 11 is connected to the circuit breaker actuator assembly through a lost motion connection means 54 which includes an elongated slot 17 and a pin 55. The pin 55 is capable of moving between a forward edge 56 and a rearward edge 57 of the lost motion slot 17.

Thus, the locking asembly 11 can move forward without simultaneous motion of the circuit breaker actuator assembly 15, 16, 18 and conversely, the actuator assembly can be moved rearwardly to move the circuit breaker 71 to the OFF position without corresponding locking assembly motion. However, with the withdrawal of a plug 75, the expanded spring 45 forces both the actuator assembly and the locking mechanism assembly 11 to the rearward position forcing the circuit breaker lever 28 to the OFF position.

Fluid tight integrity is achieved with waterproof means including a plurality of O-rings. A first O-ring 90 provides a fluid tight seal between the plug and the plug receiving means. A second O-ring 92 provides a fluid tight seal between the second passage means 84 and the plug. A third O-ring 94 provides a watertight seal betwen the plug and an electrical connection means 96 which is adapted to provide an electrical connection between the circuit breaker 71 and at least one electrical contact 98 of the plug 75.

What is claimed is:

1. An electrical switch comprising:

a housing;

a circuit breaker mounted in the interior of the housing, the circuit breaker being adapted to be connected to a source of electrical power;

a plug receiving means for receiving an electrical plug, the plug receiving means having at least one electrical connection means for providing an electrical connection between the circuit breaker and the electrical plug;

a circuit breaker actuator means extending from the housing exterior to the housing interior for changing the circuit breaker between ON and OFF states, the circuit breaker actuator means including an actuator rod slidably extending through a first passage means;

a second passage means for defining a passage from the plug receiving means into the interior of the housing;

a locking pin slidably mounted in the second passage means, the locking pin having a cam surface adjacent a first end and having a second end which is adapted to abut a received plug to be slidably moved in the passage means in response to receipt of an electrical plug from a first locking pin position to a second locking pin position;

a locking plate mounted for sliding movement transverse to the sliding movement of the locking pin, the locking plate being disposed in operative connection with the cam surface to be cammed in sliding movement thereby, the locking late being disposed in a first locking plate position when the locking pin is in the first locking pin position and being slidably cammed to a second locking plate position by movement of the locking pin to the second locking pin position; and, said first passage means being disposed adjacent the locking plate with the actuator rod and the locking plate interacting when the locking plate is in the first locking plate position for locking the actuator rod against sliding movement, whereby changing the state of the circuit breaker is prevented, changing of the circuit breaker state being permitted when the locking plate is in the second position allowing sliding movement of the actuator rod.

2. The electrical switch as set forth in claim 1 wherin the circuit breaker actuator means further includes a lost motion connection means operatively connected with the locking pin and the actuator rod, the lost motion connection means permitting sliding movement of the actuator rod when the locking pin is disposed in the second locking pin position to enable the actuator rod to change the state of the circuit breaker and blocking the actuator rod against sliding motion when the locking pin is in the first locking pin position to prevent the actuator rod from changing the state of the circuit breaker, whereby the locking plate and the lost motion connection means provide a dual safety interlock to prevent the circuit breaker from being changed to an ON state in the absence of a received electrical plug.

3. The electrical switch as set forth in claim 2 further including biasing means for biasing the locking pin to the first locking pin position whereby the lost motion connection means and the locking plate are biased toward circuit breaker actuation blocking positions.

4. The switch as set forth in claim 3 wherein the lost motion connection means includes means for defining an elongated slot, the elongated slot defining means being operatively connected with the locking pin and a pin member extending from the actuator rod through the elongated slot.

5. The electrical switch as set forth in claim 1 wherein the locking plate defines an opening therein, the opening having a first region dimensioned such that the actuator rod is permitted to slide freely therethrough and a second region of smaller size than the first region and preventing passage of the actuator rod therethrough, and wherein the actuator rod has a region of reduced diameter which is dimensioned to be received in the opening second region, the locking plate being disposed relative to the actuator rod such that in the locking plate first position, the actuator rod reduced region is received in the opening second region and in the second locking plate position the actuator rod is freely slidable through the opening first region.

6. An electrical safety switch comprising:

a watertight housing;

a circuit breaker mounted in the interior of the waterproof housing, the circuit breaker being adapted to be connected to a source of electrical power;

a circuit breaker actuator rod extending slidably through a passage in the housing from exterior to the interior, the circuit breaker actuator rod being operatively connected with the circuit breaker for changing the circuit breaker between ON and OFF states, the actuator rod having a forward edge disposed transverse to its direction of sliding movement, facing generally toward the circuit breaker;

a plug receiving means for receiving an electrical plug, the plug receiving means being connected with the housing, the plug receiving means having at least one electrical connection means for providing electrical connection between the circuit breaker and the received electrical plug;

a locking pin slidably extending through another passage in the housing from the plug receiving means to the housing interior, the locking pin having a cam surface adjacent a first end and having a second end which is adapted to contact a received plug to be slidably moved in the second passage in response to receipt of an electrical plug between a plug absent position and a plug received position;

a locking plate mounted for sliding movement transverse to the sliding movement of the locking pin, the locking plate being disposed in operative communication with the cammed surface to be cammed thereby into a lock position when the locking pin is in the plug absent position and an unlock position when the locking pin is in the plug present position, the locking plate abutting the actuator rod forward edge when the locking plate is in the lock position, whereby sliding movement of the actuator rod to change the state of the circuit breaker is blocked in the absence of a received plug;

a lost motion connection means operatively connected to the locking pin and the actuator rod such that when the locking pin is in the plug absent position, the lost motion connection means blocks the actuator rod against sliding movement to change the state of the circuit breaker and when the locking pin is in the plug received position the lost motion connection means permits the actuator rod to undergo longitudinal sliding movement to change the state of the circuit breaker; and, biasing means for a biasing the locking pin toward the plug absent position and for biasing the locking plate toward the lock position, whereby the locking plate and lost motion connection means provide a dual safety interlock to prevent the actuator rod from actuating the circuit breaker in the absence of a received electrical plug.

* * * * *